US007819025B2

(12) United States Patent
Coffland

(10) Patent No.: US 7,819,025 B2
(45) Date of Patent: Oct. 26, 2010

(54) ELECTRONIC TORQUE WRENCH AND METHOD FOR TORQUING FASTENERS

(75) Inventor: Donald W. Coffland, Seattle, WA (US)

(73) Assignee: The Boeing Company, Chicago, IL (US)

( * ) Notice: Subject to any disclaimer, the term of this patent is extended or adjusted under 35 U.S.C. 154(b) by 84 days.

(21) Appl. No.: 12/145,623

(22) Filed: Jun. 25, 2008

(65) Prior Publication Data

US 2009/0320653 A1 Dec. 31, 2009

(51) Int. Cl.
*B25B 23/14* (2006.01)

(52) U.S. Cl. ..... 73/862.21; 73/862.22

(58) Field of Classification Search .. 73/862.21–862.23
See application file for complete search history.

(56) References Cited

U.S. PATENT DOCUMENTS 3,769,860 A * 11/1973 Frings et al. ..... 81/429
4,403,531 A * 9/1983 Bailey et al. ..... 81/483
4,546,678 A * 10/1985 Stuckey ..... 81/90.6
4,967,472 A * 11/1990 Ebihara et al. ..... 29/797
5,123,289 A * 6/1992 Potesta ..... 73/862.23
5,743,158 A * 4/1998 Perkins ..... 81/58.5
6,021,694 A * 2/2000 Beger ..... 81/483
6,260,443 B1 * 7/2001 Spirer ..... 81/57.39
6,301,999 B1 * 10/2001 Garg ..... 81/61
6,796,190 B2 * 9/2004 Curry ..... 73/862.21
6,927,688 B2 8/2005 Tice
6,968,759 B2 11/2005 Becker et al.
7,089,834 B2 * 8/2006 Reynertson et al. ..... 81/479
2005/0092143 A1 5/2005 Lehnert et al.
2009/0326699 A1 * 12/2009 Coffland et al. ..... 700/108

FOREIGN PATENT DOCUMENTS

EP 09 25 1348 2/2010

OTHER PUBLICATIONS

SmartArm System shown at Internet URL: http://www.gcilift.com/html/smartarm_0.html.

* cited by examiner

*Primary Examiner*—Max Noori
(74) *Attorney, Agent, or Firm*—Tung & Associates

(57) ABSTRACT

An electronic torque wrench having a flexible head provides accurate torque measurements irrespective of the angular position of the head relative to a handle on which the force is applied. The head includes first and second portions connected by at least three pivotal links. One of the links is used to react against the entire torque applied to the handle, regardless of the pivotal position of the handle. An electronic strain gauge on the torque-reacting link provides a measurement of the torque applied to the fastener.

22 Claims, 11 Drawing Sheets

| REGION | TORQUED STATUS | |
|---|---|---|
| | TORQUED | UNTORQUED |
| RH PRESSURE DECK | 121 | 31 |
| LH PRESSURE DECK | 186 | 13 |
| RH FORWARD BULKHEAD | 122 | 86 |
| LH FORWARD BULKHEAD | 177 | 45 |
| AFT BULKHEAD | 65 | 8 |
| KEEL BEAM | 43 | 0 |

ELECTRONIC TORQUE WRENCH AND METHOD FOR TORQUING FASTENERS

CROSS REFERENCE TO RELATED APPLICATIONS

This application is related to co-pending U.S. patent application Ser. Nos. 12/145,604, and 12/145,637 both filed concurrently herewith on Jun. 25, 2008, each of which applications is incorporated by reference herein in its entirety.

TECHNICAL FIELD

This disclosure generally relates to tools, especially hand tools, and deals more particularly with an electronic torque wrench having a flexible head allowing the handle to pivot to multiple positions.

BACKGROUND

Torque wrenches are commonly used to precisely set the torque of a fastener such as a nut or bolt, where the tightness of the fastener may be important. Some torque wrenches allow a user to also measure the torque (rotational force) applied to the fastener so that it may be matched to a torque specification.

A variety of torque wrenches have been developed, including mechanical types which may employ a beam that deflects under the applied torque, and electronic types which employ a strain gauge attached to a torsion rod. Some conventional torque wrenches employ a handle having a fixed head that includes a socket or other fitting for engaging the fastener. These fixed-head torque wrenches may not be suitable for use where the fastener is close to obstructions that interfere with grasping or rotating the handle. In these applications, it may be necessary to employ a torque wrench in which the head is pivotally attached to the handle by a hinge. The hinge allows the handle to be swung to a position where it may be freely rotated, out of the path of the obstruction. A problem may arise with these torques wrenches, which are sometimes referred to as "flexible head" torque wrenches, due to the fact that when the handle is swung away from a position in which it is axially aligned with the head, a portion of the force applied to the handle results in a force component that is not orthogonal to the rotational axis of the fastener. This "off-axis" force component may cause inaccuracies in torque readings.

Accordingly, there is a need for a torque wrench having a flexible head that provides accurate torque measurements irrespective of the off-axis, pivotal position of the handle.

SUMMARY

The disclosed electronic torque wrench allows for variable off axis torquing of fasteners and may be used in applications where a desired amount of torque must be applied, but where right angle access to the fastener is limited. The disclosed electronic torque wrench includes a flexible head that allows the handle of the wrench to be swung to any of a plurality of positions in order to avoid obstructions. Means for measuring the torque applied to a fastener is located on the head and is therefore substantially unaffected by off-axis loading by the handle. The torque measuring means may comprise a link that reacts against the applied torque, coupled with a strain gauge sensor that measures the force on the link and generates a torque measurement signal, which, in one embodiment, may be wirelessly transmitted to a remote site.

According to one disclosed embodiment a torque wrench comprises: a handle; and, a head including a first portion for engaging and applying torque to a fastener about a rotational axis of the fastener, a second portion pivotally coupled with the handle for allowing the handle to pivot to any of a plurality of positions relative to the head, and means on the head for measuring the amount of torque applied to the fastener irrespective of the pivotal position of the handle relative to the head. The measuring means may be connected between the first and second portions of the head, and may include a link reacting against the applied torque and coupled with a strain gauge for measuring the strain on the link.

According to another disclosed embodiment, an electronic torque wrench having a flexible drive head comprises: a handle for applying a force; a head including a first portion adapted to engage and apply a torque to a fastener about an axis of rotation, and a second portion between the handle and the first portion; a hinge pivotally connecting the handle with the second portion of the head and allowing the handle to pivot to any of a plurality of positions relative to the head; a force-reacting first link connecting the first and second portions of the head for reacting against substantially the entire torque applied through the handle to the first portion of the head irrespective of the pivotal position of a handle; and, an electronic sensor on the head for measuring the amount of torque applied to the fastener. The electronic torque wrench may further comprise second and third links connecting the first and second portions of the head which react against an off-axis force applied to the fastener that does not result in torque being applied to the fastener.

According to a method embodiment, applying and measuring torque on a fastener using a torque wrench having a pivotal head, comprises: separating the head into first and second portions; connecting the first and second portions of the head by at least a first link; transmitting substantially all of the torque applied to the fastener through the first link; and measuring the torque transmitted to the first link.

The disclosed embodiments satisfy the need for a torque wrench and method of torquing a fastener which substantially eliminate error in torque measurements resulting from off-axis forces applied to the torque head.

Other features, benefits and advantages of the disclosed embodiments will become apparent from the following description of embodiments, when viewed in accordance with the attached drawings and appended claims.

BRIEF DESCRIPTION OF THE ILLUSTRATIONS

DETAILED DESCRIPTION

Figure 1:
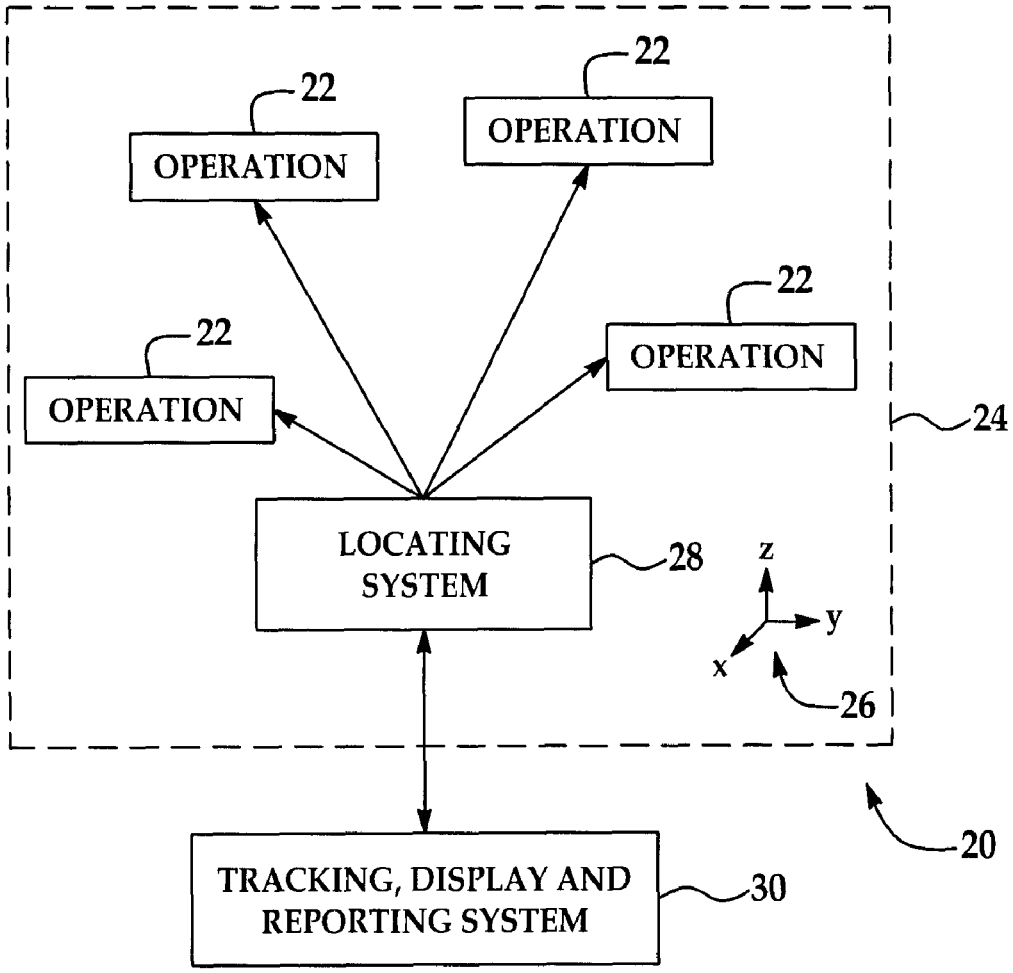
FIG. 1 is a block diagram of a system for locating the completion of manufacturing operations.

Referring first to FIG. 1, a system generally indicated by the numeral 20 may be used for locating each of a plurality of manufacturing operations 22 within a manufacturing 24, and for reporting the status of at least one operation at the located manufacturing. The reported status may including notice that the operation has been started, is underway and/or has been completed. The three dimensional location of each of the operations 22 may be defined in a three dimensional coordinate system 26 within the manufacturing environment 24. In one embodiment, the manufacturing environment may be a harsh RF environment in which obstructions or other environmental factors result in RF signal reflection, signal attenuation and/or signal blockage due to the lack of LOS between transmitter and receiver.

The locating and reporting system 20 may include a locating system 28, and a reporting and display system 30 which can be used to monitor the location of the manufacturing operation 22 within the coordinate system 26 and display these operations as well as the status of the manufacturing operation 22 within a second, later discussed coordinate system. As will be discussed below in more detail, the system 20 may be used to locate each of the manufacturing operations 22 directly or indirectly by locating a portable component such as a torque wrench which is moved to the location of each of the manufacturing operation 22.

Figure 2:
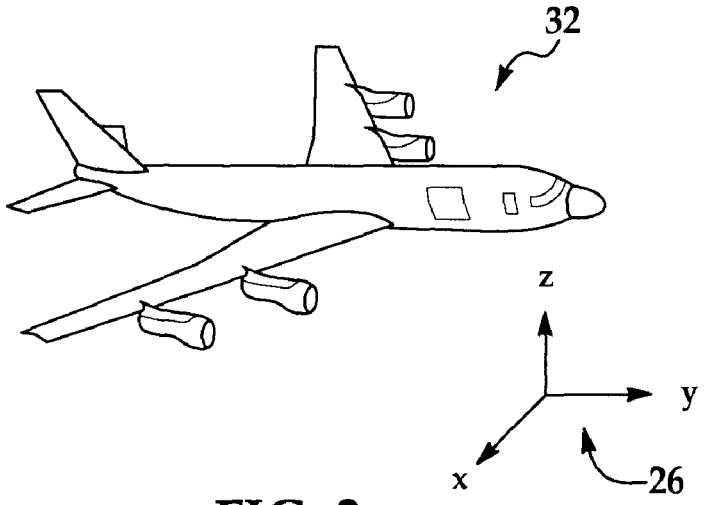
FIG. 2 is a perspective view of an aircraft, including a three dimensional coordinate system used to define the location of manufacturing operations performed within the aircraft.
Figure 3:
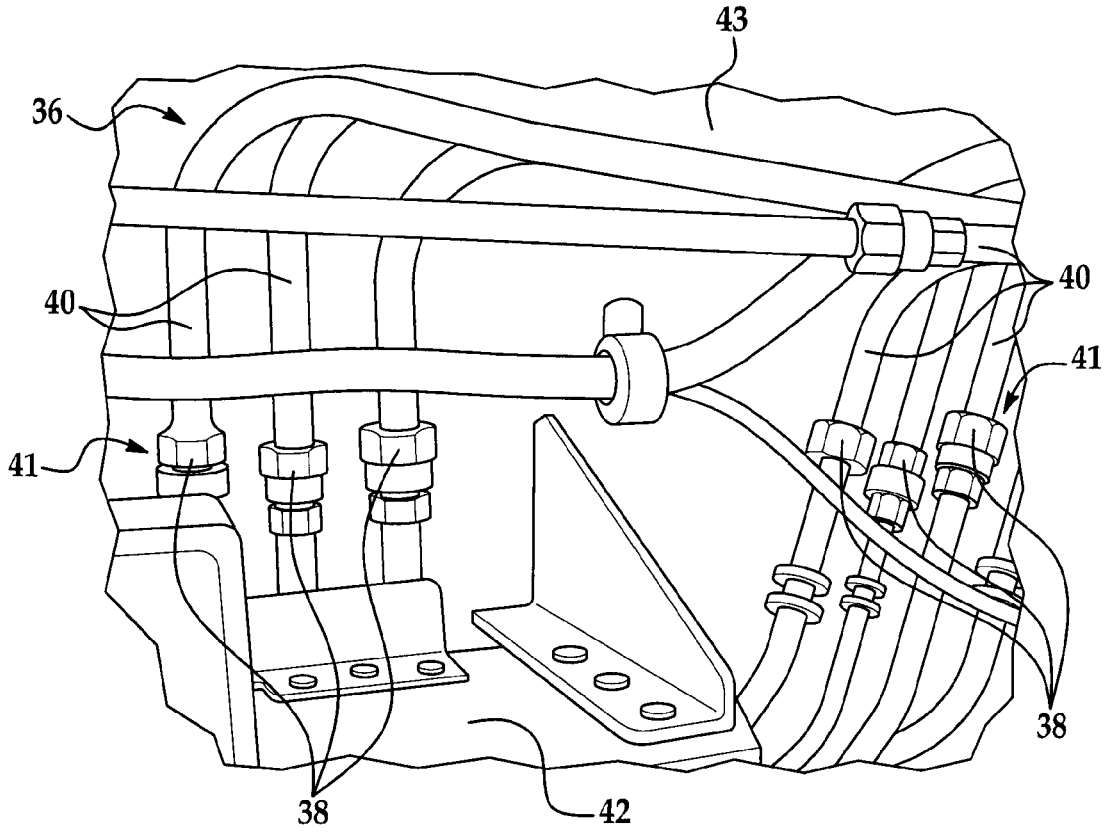
FIG. 3 is a perspective view showing a portion of a wheel well forming part of the aircraft shown in FIG. 2.

Referring to FIG. 2, the locating and reporting system 20 may be used to locate manufacturing operations 22 on an aircraft 32, in which object space may be defined in a three dimensional coordinate system 26 of the aircraft 32. The manufacturing operations 22 may comprise, for example and without limitation, operations such as the assembly of subassemblies (not shown) during the production of the aircraft 32. For example, as shown in FIG. 3, a wheel well 36 on the aircraft 32 may contain a multiplicity of hydraulic tubes 40 having threaded fittings 41 provided with nuts 38 for connecting and tightening the fittings 41. The assembly of the fittings 41, including torquing of the nuts 38, comprises assembly operations that may be monitored and reported using the disclosed system 20. The wheel well 36 may include various metallic structures 42 used for reinforcement or component mounting that preclude LOS within the wheel well 36 and/or reflect or attenuate RF signals. In some cases, the nuts 38 may be located in close quarters to which there may be limited access, as where they are tightly grouped, for example, against a bulkhead 43.

Figure 4:
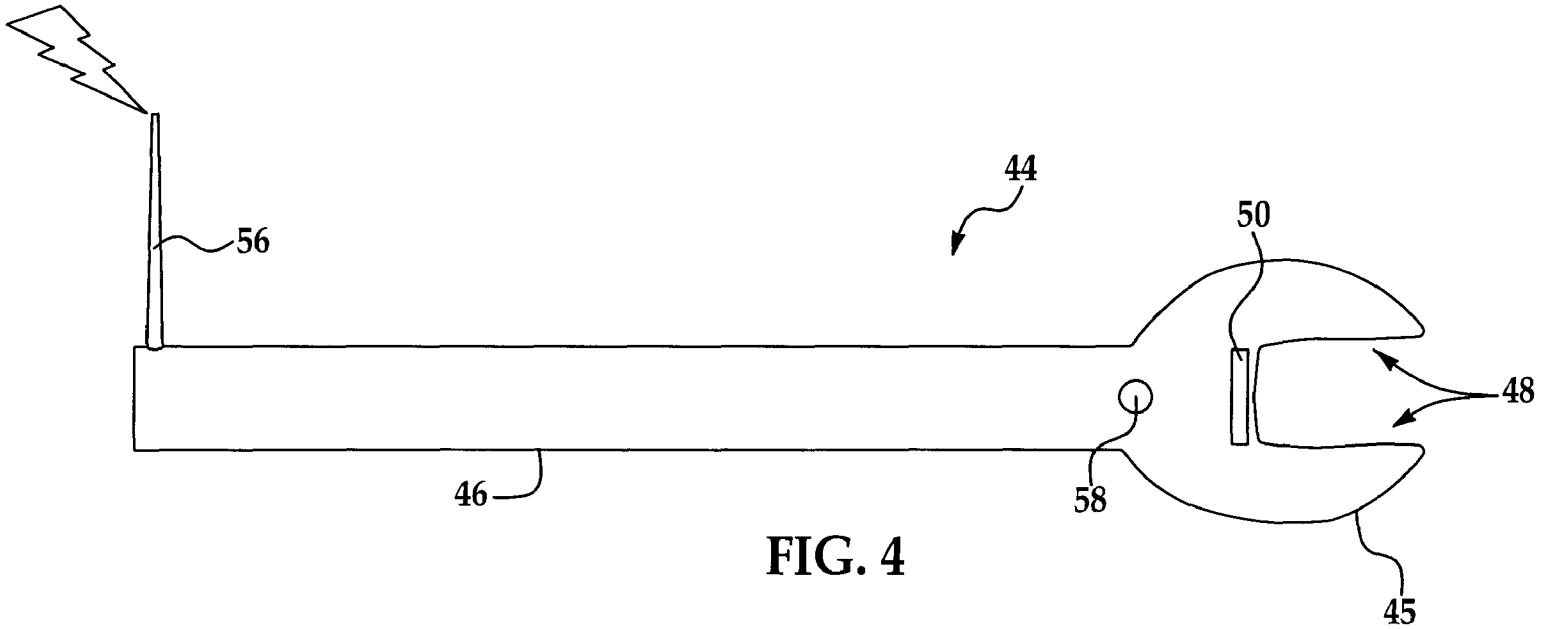
FIG. 4 is a side view of one embodiment of a wrench used to torque nuts on hydraulic fittings within the wheel well shown in FIG. 3.
Figure 5:
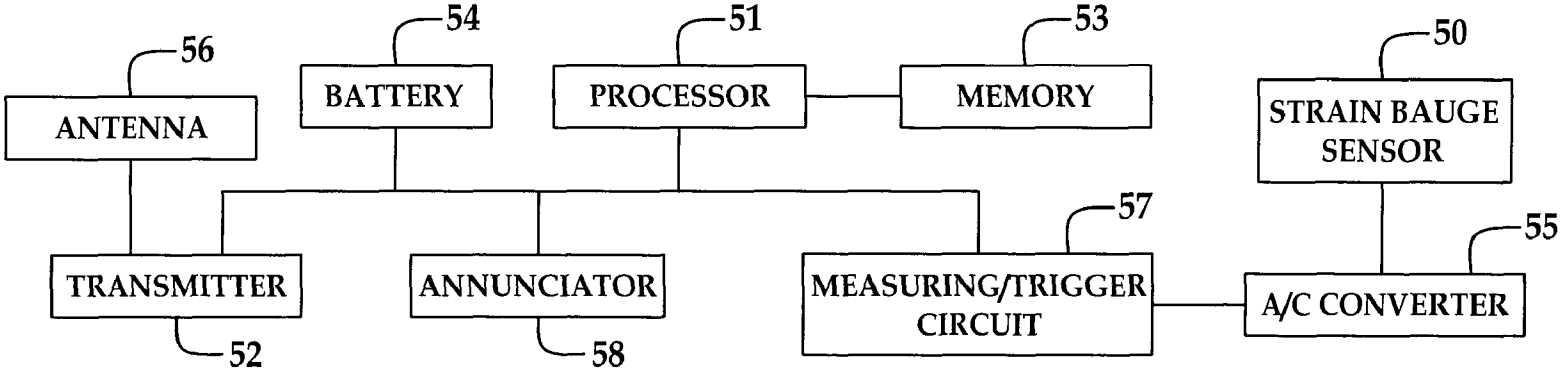
FIG. 5 is a block diagram of a circuit forming part of the torque wrench shown in FIG. 4.
Figure 6:
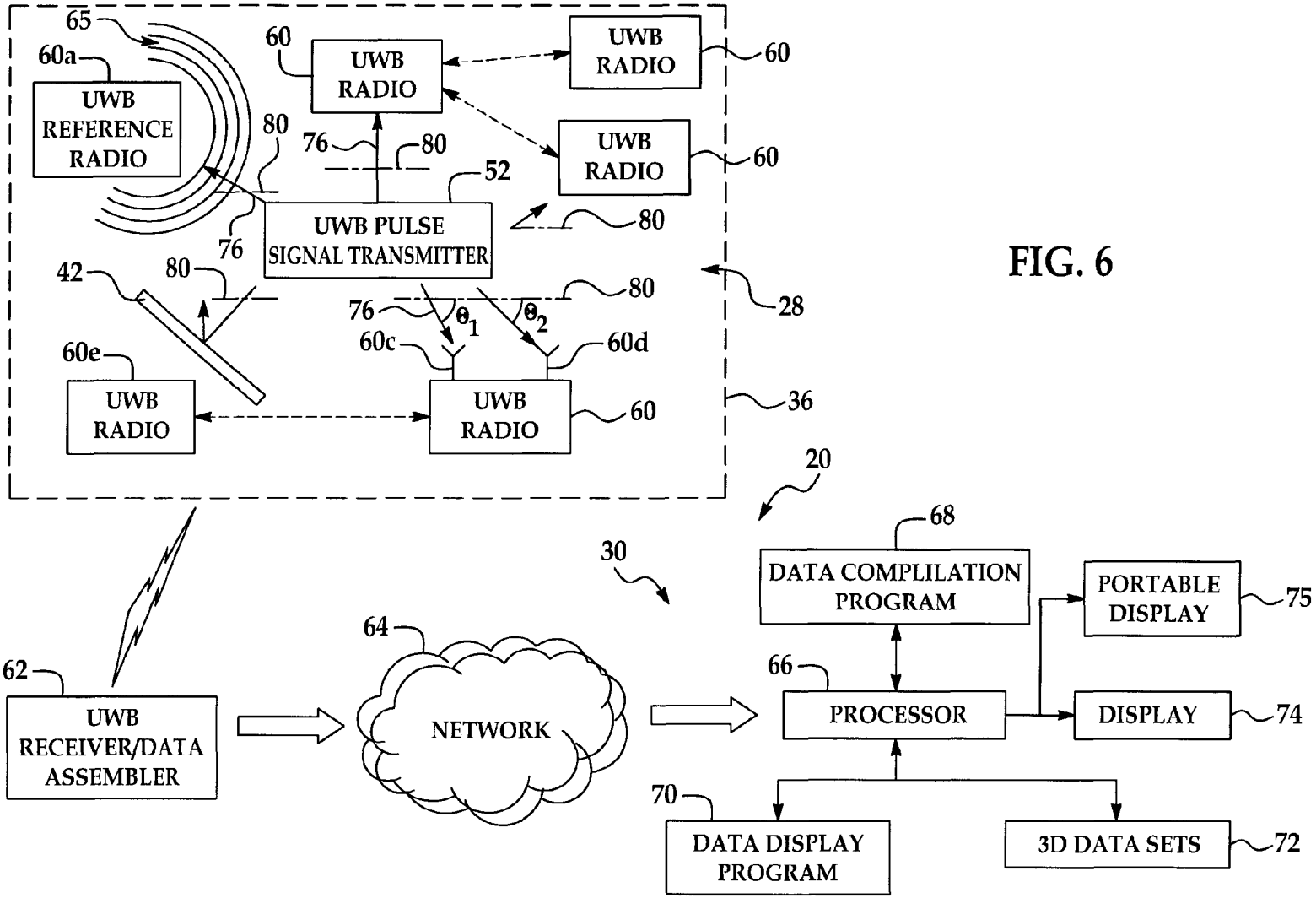
FIG. 6 is a combined block and diagrammatic illustration of a system for locating and reporting the completion of manufacturing operations performed in a harsh RF environment.

Reference is now made to FIGS. 4-8 which depict additional details of the locating and reporting system 20 adapted for use in locating and reporting the torque condition of the nuts 38. In this application, as best seen in FIG. 6, the system 20 may utilize a UWB pulse signal locating system 28 which comprises a UWB pulse signal RF transmitter 52 carried on an electronic torque wrench 44, and a plurality of UWB radios 60 that are optimally positioned within the wheel well 36 such that at least two of the UWB radios 60 are within the LOS of each of the nuts 38.

As shown in FIG. 4, the electronically monitored torque wrench 44 used to torque the nuts 38 includes a head 45 mounted on the end of a handle 46. The head 45 includes jaws 48 for engaging the flats of the nuts 38, and a strain gauge sensor 50 mounted near the jaws 48. The strain gauge sensor 50 produces an electrical signal related to the magnitude of the torque applied to a nut 38 by the wrench 44.

Additional components contained within the wrench 44 are shown in FIG. 5. The UWB pulse signal transmitter 52 is contained within the handle 46 and transmits UWB pulse signals on an antenna 56 carried on or within the handle 46. The UWB pulse signals transmitted by the UWB pulse signal transmitter 52 may include data representing the magnitude of torque sensed by the strain gauge sensor 50, or more simply that a torque of unreported value has been applied. The analog signal generated by the strain gauge sensor 50 may be converted to a digital signal by an A-to-D converter 55. A measuring/trigger circuit 57 measures the digital signal and issues a trigger signal when the measured signal exceeds a threshold value, indicating, for example, that a nut has been torqued to a nominal value, or has surpassed a minimum threshold to indicate torque has been or is being applied. A microprocessor 51 and associated memory control various operations of the wrench, including the transmitter 52 and an annunciator 58 on the wrench head 45 which alerts assembly worker that the torque being applied to a nut 38 has reached a nominal value, which may be stored in the memory 53. The annunciator 58 may comprise for example and without limitation, an LED or other light (shown at 58), an audio signal generator (not shown) or a vibrator (not shown) in the handle 46. The electronic components of the wrench 44, including the transmitter 52 may be powered by a battery 54 housed within the handle 46. It may be possible to retrofit conventional wrenches with one or more of the electronic components mentioned immediately above to provide the required functions of the electronic torque wrench 44.

Certain manufacturing operations requiring the use of the electronic torque wrench 44 may be conducted within harsh RF environments, such as the illustrated aircraft wheel well application, that lack infrastructure which could otherwise provide references useful in making location measurements. Accordingly, in harsh RF environments, the nodes, i.e. radios 60 may be deployed at positions that optimize LOS communication with the locations where the nuts 38 are to be torqued. The common coordinate system 26 established within the wheel well 36 allows estimations of locations within a common frame of reference. It may also be desirable to optimize the transmission protocol in order to reject reflective signals by using timing techniques carried in the leading edge of the transmitted, UWB pulse signals.

According to one embodiment, the generated pulse signals may be baseband signals that are mixed by a mixer to move their center frequency to the desired frequency bands which may be, in an application involving monitoring of nut torquing within a wheel well 36, around 4 GHz, providing an effective spectrum of approximately 3.1 to 5.1 GHz, and location measurement accuracy less than approximately one-half inch. In other applications, a UWB pulse signal generator 52 having a center frequency of approximate 6.85 GHz for a full FCC part 15 spectrum spread of 3.1-10.6 GHz, may be appropriate.

In accordance with the disclosed embodiments, the deployment of ad hoc nodes in the form of the radios 60 can be used to navigate around any blockages in the LOS between the location of the pulse signal generator 52 and the radios 60. Various reference materials exist in the art which teach suitable methods and techniques for resolving positional estimates in a network of ad hoc nodes including, for example and without limitation the following:

"Robust Header Compression WG", URL: http://www3.ietf.org/proceedings/04nov/slides/rohc-0.pdf Perkins, C., "Ad hoc On-Demand Distance Vector (AODV) Routing", Network Working Group, RFC 3561, July 2003.

Agarwal, A. and S. Das, "Dead Reckoning in Mobile Ad-Hoc Networks", IEEE WCNC 2003, the 2003 IEEE Wireless Communications and Networking Conference, March 2003.

Thales, Research & Technology Ltd. "Indoor Positioning", URL: http://www.thalesresearch.com/Default.aspx?tabid=166

Some of the techniques well known in the art use iterative lateration of the generated pulse signals by solving a constraint based positional model. While this approach may be satisfactory for some applications, in other applications, such as locating nuts within an aircraft wheel well, it may be necessary that the ad hoc network be propagated with position aware nodes in order to provide the desired results.

As will be discussed below in more detail, the UWB radios 60 receive the pulse signals from the wrench 44 and generate location measurements that may be used to calculate the location of the wrench 44, and thus, the location of the nut 38 being torqued by the wrench 44. In other embodiments, it may be possible to use one or more UWB radios 60*b* which include a pair of spaced apart receiving antennas 60*c*, 60*d*. The UWB radio 60*b* generates location measurements based on the angle of arrival (AOA) and the time difference of arrival (TDOA) of the pulse signals 76 transmitted by the pulse signal transmitter 52 on the wrench 44. In the case of the UWB radio 60*b*, the pulse signals 76 arrive respectively at the two antennas 60*c*, 60*d* at slightly different angles $\theta_1$ and $\theta_2$ relative to a reference axis 80 that is based in the coordinate system 26 (FIGS. 1 and 2) used to locate the nuts 38 in the three dimensional object space. Similarly, UWB radios 60 each measure the AOA and TDOA of the arriving pulse signals 76 relative to the reference axis 80. The AOA and TDOA measurements generated by at least two of the radios 60 may then be used to calculate the three dimensional location of the pulse signal transmitter 52 (and thus the wrench 44 and nut 38) using common iterative lateralization techniques.

Any of several different techniques may be employed for measuring the AOA positioning. One such method has been previously described in which the UWB radio 60*b* includes two spaced apart receiving antennas 60*c*, 60*d* each of which receives the signal transmitted by the pulse signal transmitter 52. The angle of the line connecting the radio 60 and the torque wrench 44 is measured with respect to source data stored in the 3D data set files 72. This reference angle corresponds to the orientation of the line intersecting each of the collocated antennas 60*c*, 60*d*. By measuring orientation to multiple reference antennas, the position of the torque wrench 44 may be determined.

Various techniques can be used for measuring TDOA. One such method involves receiving the transmitted pulse signals by multiple UWB radios 60 and dedicating one of the receiving radios 60*a* to calibrating the remaining radios 60 in the network. The receiving radio 60 determines the direct path to the intended torque wrench 44 by measuring the TDOA of the signal. At least four such measurements may be required to determine the position of the torque wrench 44 by interative lateration.

The performance of the radios 60 may be measured in terms of the packet success rate, accuracy of measured vs. actual distance, standard deviation and the signal/noise levels. The packet success rate may be defined as the number of successful packet exchanges between the radios 60. The measured distance is computed by processing the UWB pulse signals transmitted by the pulse signal transmitter 52. The actual distance is the distance between two receiving radios 60 as measured using a physical device. The standard deviation is a measure of how widely the measured distance values are dispersed from the mean. The signal and noise levels may be computed from the signal waveform as follows:

$$SignalLevel = 10 * \log\left(\frac{SquareofMaxValueofADCCounts}{2}\right)$$

$$NoiseLevel = 10 * \log(NoiseVarianceof5nsOfTheWaveform)$$

The system 28 may include a UWB reference radio 60*a* which broadcasts a beacon signal 65 that is used to calibrate the UWB radios 60. Because of the close quarters and various obstructions such as structure 42 that may be present within the wheel well 36, one or more of the UWB radios, such as UWB radio 60*c* may not be within the LOS of the pulse signal transmitter 52. The required accuracy or location measurement where the LOS between the transmitter 52 and one of the radios 60 is blocked can be overcome by installing extra radios 60 over the minimum number required for normal TDOA calculations, and then performing signal processing algorithms to identify the particular receiver that is not within LOS with the pulse signal transmitter 52.

The location measurements generated by the UWB radios 60 may be transmitted from the system 28 to a UWB receiver and data assembler 62 which assembles the location measurements, along with the torque data forming part of the pulse signals transmitted from the wrench 44. Depending upon the application, the assembled data may be transmitted through a network 64 to the monitoring, display and reporting system 30. The networks 54 may comprise, for example and without limitation, a WAN, LAN or the Internet. The monitoring, display and reporting system 30 may include a processor 68, data compilation program 68, data display program 70, three dimensional data set files 72 and one or more displays, such as the display 74 and a portable display 75.

The processor 66 may comprise a programmed PC which uses the compilation program 68 to calculate the position of the pulse signal transmitter 52 based on the location measurements. The processor 66 also uses the display program 70 to cause the display of images which illustrate or highlight the location of the nut 38 being torqued within a three dimensional image produced from the data set files 72. The three dimensional data set files 72 may comprise, for example and without limitation, a CAD file produced by any of various solid modeling programs such as, without limitation, CATIA. In effect, the system 30 maps the locations of the nuts 38 to data set coordinates in the solid modeling program.

Figure 7:
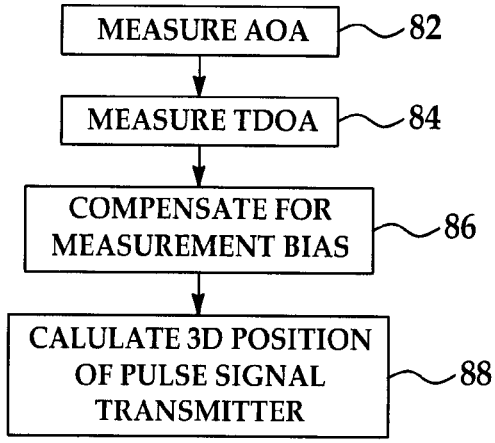
FIG. 7 is a simplified flow diagram of a method for locating the three dimensional position of the pulse signal transmitter forming part of the system shown in FIG. 6.

The method for calculating the position of the pulse signal transmitter 52 is illustrated in FIG. 7 in which the AOA and TDOA are respectively measured at 80 and 84 by the UWB radios 60. In some cases, measurement bias may be introduced as a result of the lack of LOS between radios 60, and incorrect lock on the signal to detect direct path or leading edge of the signal. This is due to the consistent leading edge detection occurring at the shortest path between the radios 60. This measurement bias may be compensated using any of several methods, including using leading edge algorithms using look-up tables for regions within the wheel well 36 to compensate for the bias or for counting for the error as position errors. Accordingly, compensation may be made at 86 for the measurement bias. Finally, at 88, the processor 66 calculates the three dimensional position of the pulse signal transmitter 52 within the coordinate system 26 of the manufacturing environment 24, which in the illustrated example, comprises the wheel well 36.

Figure 8:
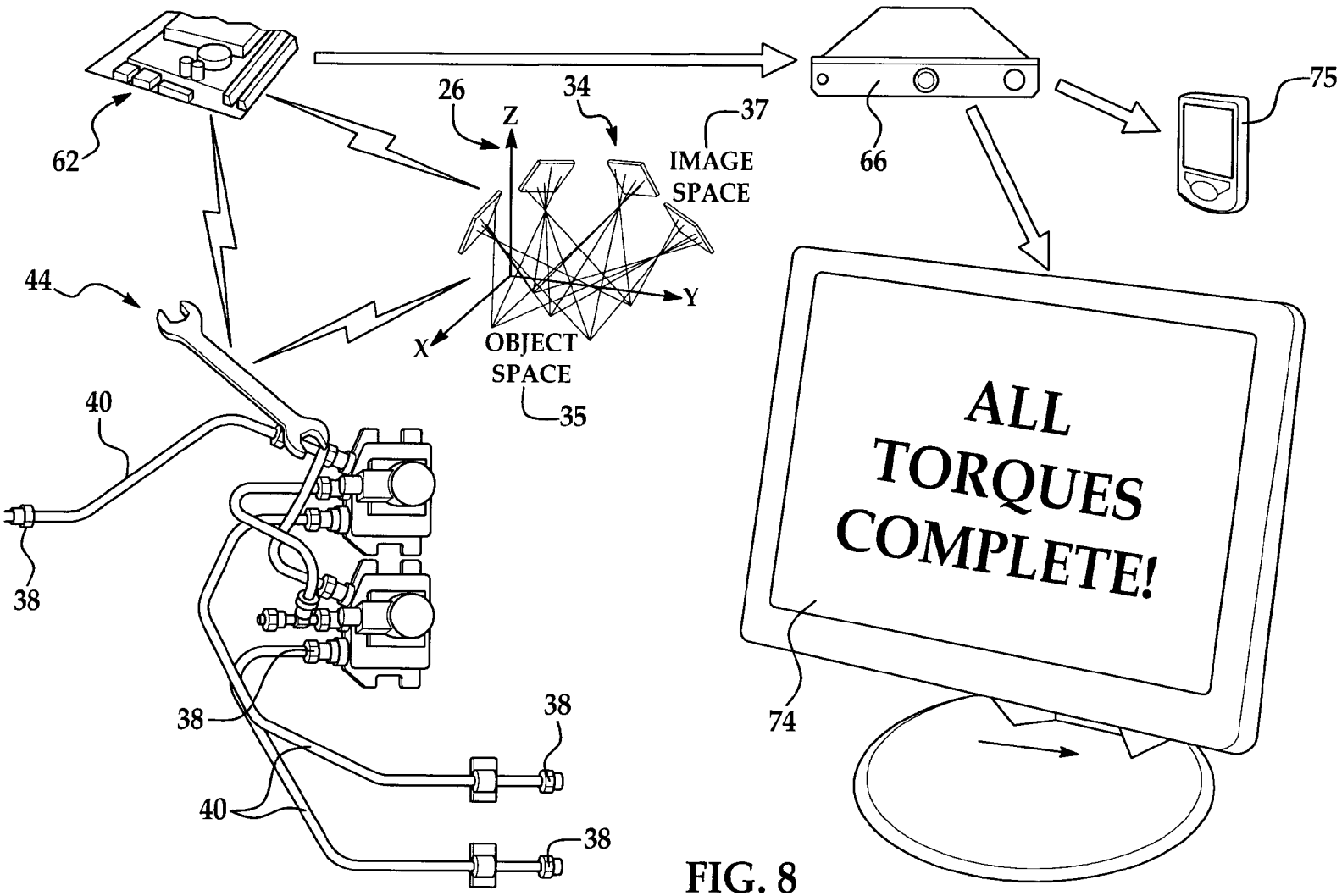
FIG. 8 is a diagrammatic illustration showing the major components of the system for locating and reporting the completion of manufacturing operations.

Referring now particularly to FIG. 8, the displays 74, 75 each combine graphic and quantitative data in real time to provide a display of the current state of the wheel well 36. In order to display the nut 38 being torqued in a three dimensional reference image assembled from the 3D data set files 72, the processor 66 mathematically translates the 3D location of the pulse signal transmitter 52 in the coordinate system 26 of wheel well 36, to a second coordinate system 34 of the 3D image created from the data set files 72. The first coordinate system 26 effectively defines object space 35, i.e. the 3D space in which the wrench 44 is moved from nut-to-nut 38, and the coordinate system 34 defines the image space 37 containing the displayed the image created from the 3D data set files 72.

The main display 74 may be used by production personnel to remotely locate, monitor and record the status (e.g. initiation, progress and/or completion), of assembly operations, such as the torquing of the nuts 38. Additionally, a portable display 75 may be employed by an assembly worker to view the same or similar data that is displayed on display 74 so that the worker can monitor and verify which of the nuts 38 have been torqued, or have yet to be torqued.

Figure 9:
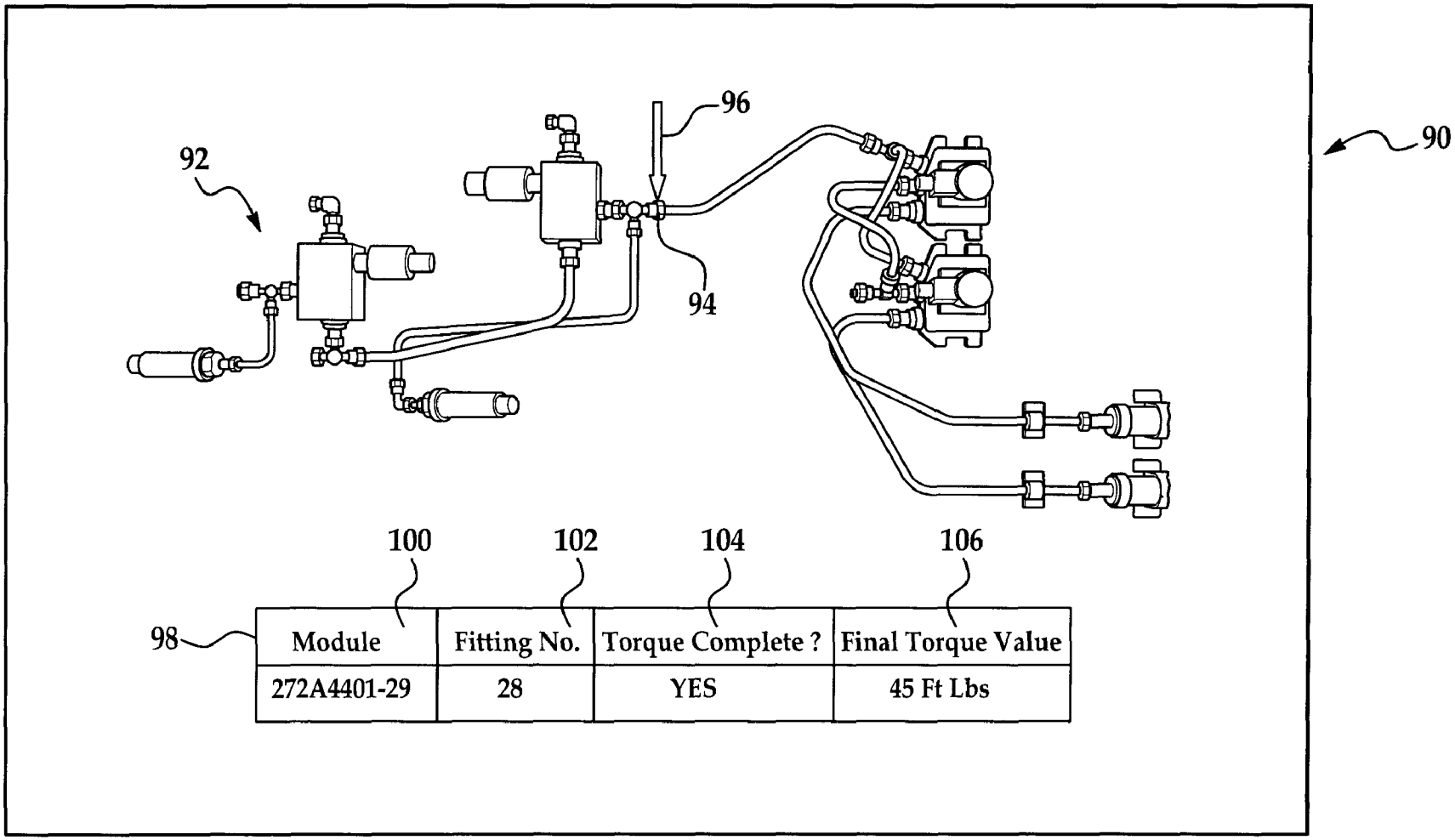
FIG. 9 is one typical screen display showing a located manufacturing operation and reported completion status.

Reference is now made to FIG. 9 which discloses a typical screen display 90 that may be viewed on either of the displays 74, 75. In this example, a hydraulic module 92 is displayed in which an arrow 96 is used to indicate a particular nut 94 that is or has just been torqued. Summary information in a table 98 may also displayed which may indicate a module number 100 identifying the module 92, a fitting number 102 identifying the particular fitting being torqued, the status 104 of torque completion and a final torque value 106.

Figure 10:
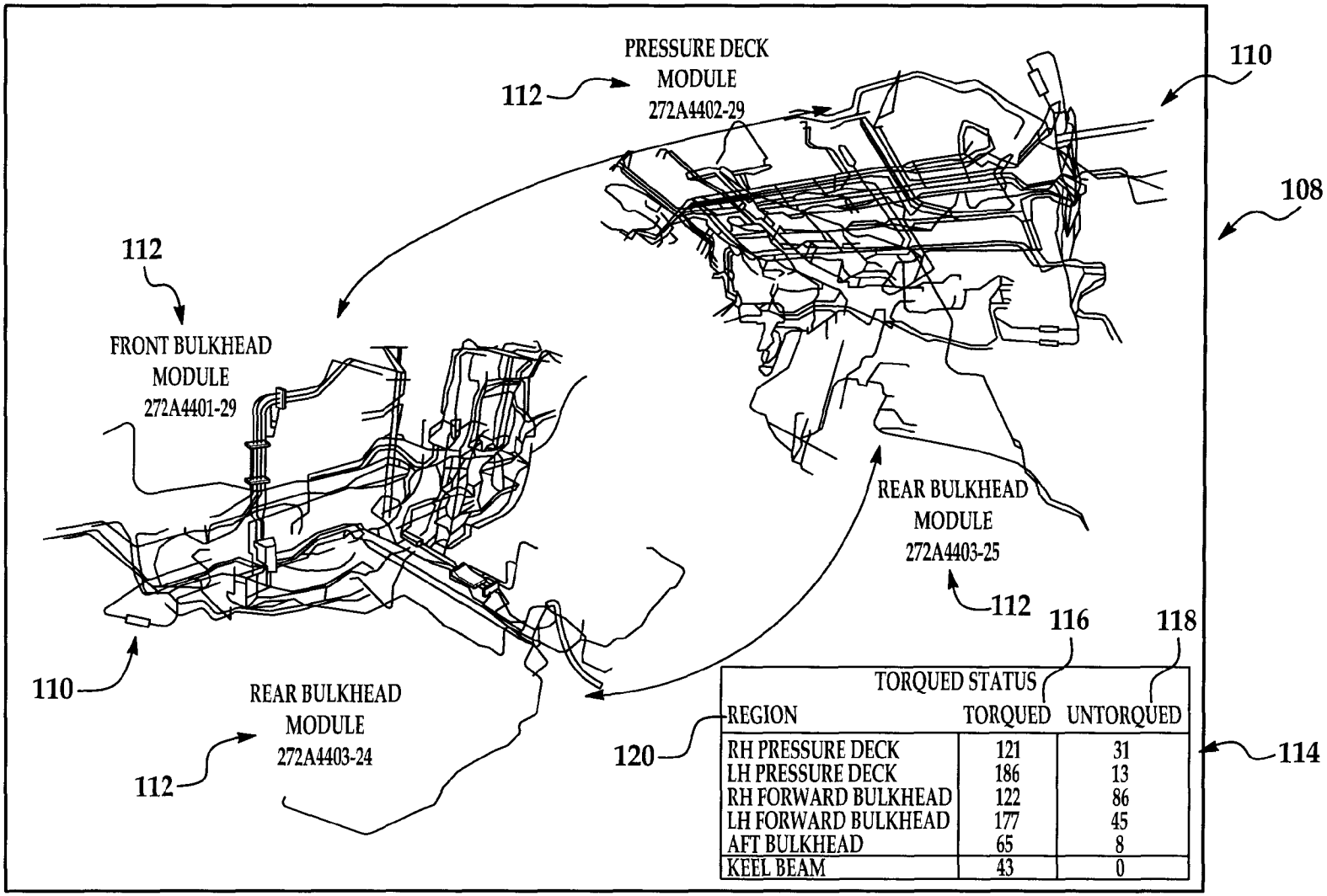
FIG. 10 is another screen display showing summary information related to manufacturing operations and reported completion status.

Referring now also to FIG. 10, summary information may be displayed on the display 74 that may include groups 110 of modules along with indicia 112 that identifies the module group. Additionally, tables 114 may be displayed that show torque status in summary form. For example, the torque status may include the number 116 of nuts that have been torqued for a module group 110, and the number 118 of nuts that have not yet been torqued for each of the module group regions 120. A variety of other types of specific of summary information may be displayed along with images of the modules and/or fittings, all in real time while an assembly worker is assembling the fittings and torquing the nuts 38.

Figure 11:
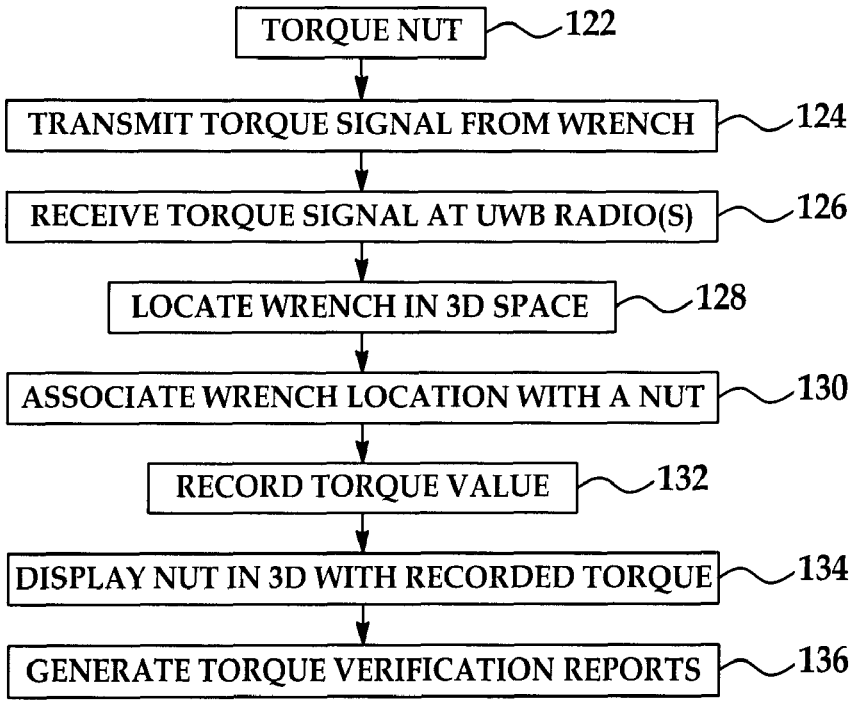
FIG. 11 is a simplified flow diagram illustrating a method for locating and reporting the completion of manufacturing operations.

Referring to FIG. 11, according to a method embodiment, torquing of the nuts 38 may be monitored, recorded and displayed. Beginning at 122, a production worker uses the electronic wrench 44 to torque a nut 38. When the strain gauge 50 (FIGS. 4 and 5) senses that the nominal or threshold torque value has been reached, the wrench 44 transmits torque signals comprising UWB pulse signals that contain the torque value, shown at step 124. The torque signals (UWB pulse signals) are received at the UWB radios 60 within the wheel well 36, as shown at 126. The resulting location measurements are then used by the processor 66 to calculate the location of the wrench 44 in three dimensional object space, as shown at 128. At 130, the processor 66 associates the wrench location with a particular nut 38, and at 132, the torque value for the nut is recorded. At 134, the processor 66 translates the location of the nut from the coordinate system 26 of the wheel well 36, to the coordinate system 34 of the three dimensional space represented by the displayed image. The nut 38 is then displayed along with the recorded torque value at 134. Torque verification reports may be optionally generated, as desired, at 136.

The disclosed embodiments described above may provide for the acquisition and display of both the location and quantitative data relating the manufacturing operation that is performed. For example, where the torque wrench 44 transmits signals that identify its location and a torque reading, both the location of the wrench 44 and the acquired torque reading may be remotely or locally recorded and displayed. However, the disclosed embodiments may also be useful where the signals transmitted from the wrench 44 contain only information indicating the location of the wrench 44. For example, when a worker initiates and/or completes a torquing operation, he or she may manually initiate the transmission of a signal from the wrench 44 using a transmit switch (not shown) on the wrench 44 which initiates transmission of a signal that indicates the location of the wrench, and inferentially, that an operation has just been initiated or taken place on a fitting at the location of the wrench.

Figure 12:
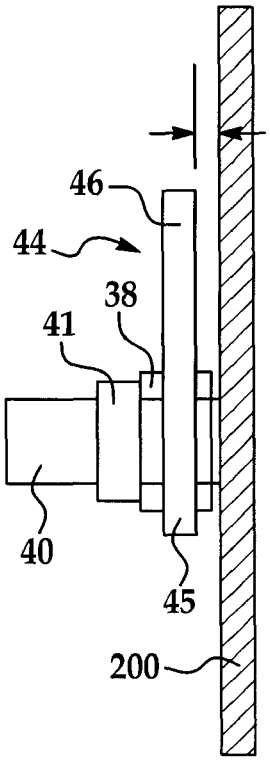
FIG. 12 is a side view of a fixed-head torque wrench placed on a fastener in proximity to an obstruction allowing limited handle clearance.
Figure 13:
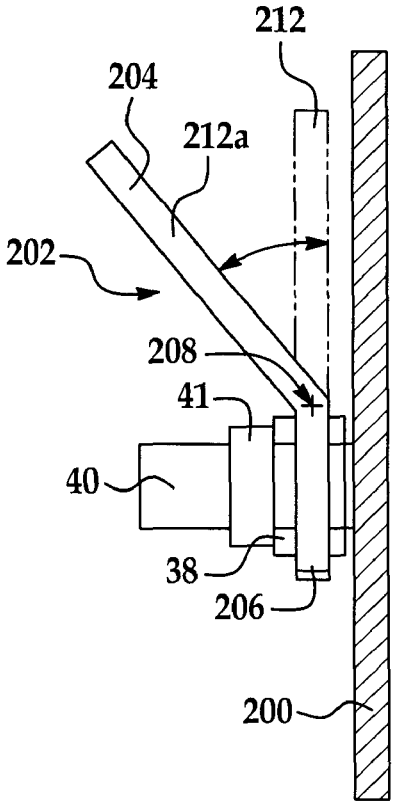
FIG. 13 is a view similar to FIG. 12 but depicting the use of a torque wrench having a flexible head to avoid the obstruction.

Referring now to FIG. 12, the head 45 of the previously described electronic torque wrench 40 may be positioned around a nut 38 used to tighten a fitting 41 on a tube 40. The position of the handle 46 is fixed relative to the head 45. In this example, the handle 46 of the wrench 44 is closely positioned next to an obstruction 200 which may comprise, for example and without limitation, a bulkhead in which the clearance space "C" is insufficient for a worker to grasp the handle 46. One solution to this problem is shown in FIG. 13 which illustrates an electronic torque wrench 202 in which the handle 204 is pivotally connected to a head 206 by means of a hinge 208, and thus may be referred to as having a "flexible head" 206. By virtue of the pivotal connection formed by the hinge 208, the handle 204 may be swung through any angle θ so that a worker may freely grasp and rotate the handle 204, free of the obstruction 200.

Figure 14:
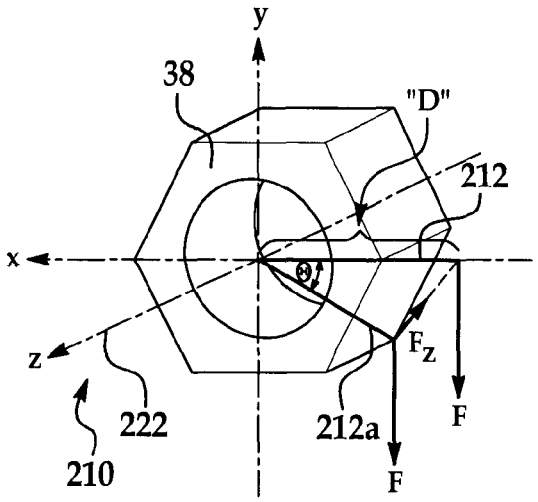
FIG. 14 is a perspective view of a nut illustrating the forces applied to the nut by a torque wrench.

Attention is also now directed to FIG. 14 which illustrates the forces applied to the nut 38 using the torque wrench 202 shown in FIG. 13. The symmetry of the nut 38 may be defined in a three dimensional coordinate system 210 comprising orthogonal x, y and z axes. The z axis forms the axis of rotation 222 of the fastener 38. The rotational force, i.e. torque, which produces rotation of the nut 38 is applied to the fastener 38 within a plane defined by the x and y axes and which is orthogonal with respect to the axis of rotation 222. When the handle 204 of the wrench 202 is axially aligned with the head 206 as shown by the dashed line position 212 in FIG. 13, the force F applied to the handle 204 acts through a distance "D" within the x-y plane to produce a torque which is the product of F×D. When, however, the handle is swung to the full line (FIG. 13) position 212*a* through an angle θ, a portion of the applied force F results in an "off axis" force component $F_z$ parallel to the z axis. The off-axis force component $F_z$ may result in an error in torque measurement. In other words, when the force F is not applied entirely within the x-y plane orthogonal to the axis of rotation 222, the torque readings may contain an error. This error is sometimes referred to as the "cosine error" since the magnitude of the error is proportional to the cosine of the angle θ.

Figure 15:
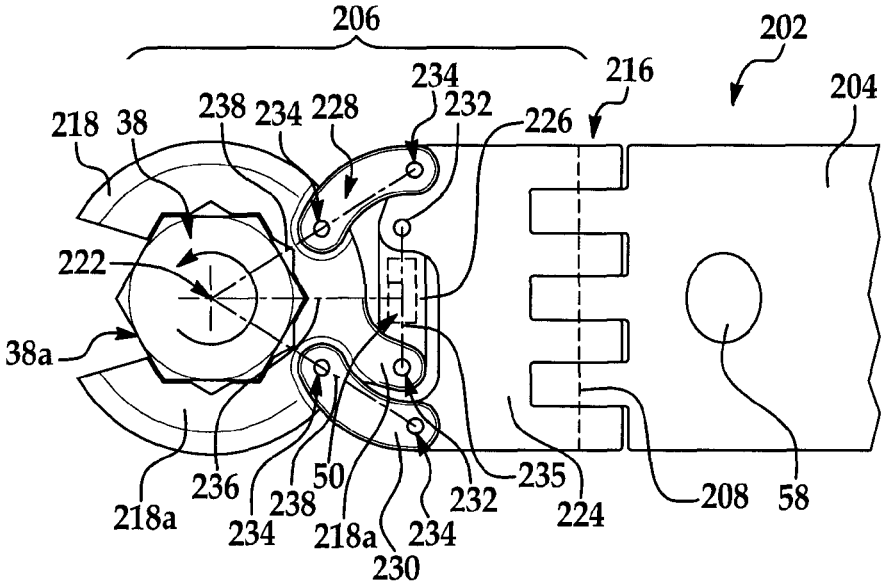
FIG. 15 is a top view of a portion of an electronic torque wrench according to one embodiment, shown engaging a fastener.
Figure 16:
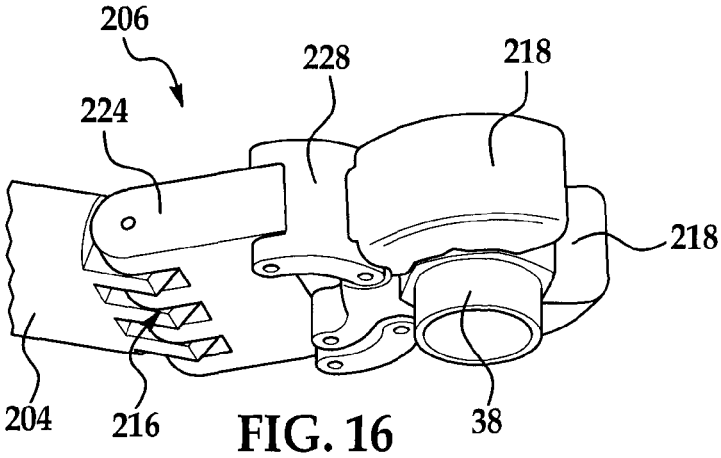
FIG. 16 is a perspective view of the torque wrench shown in FIG. 15.
Figure 17:
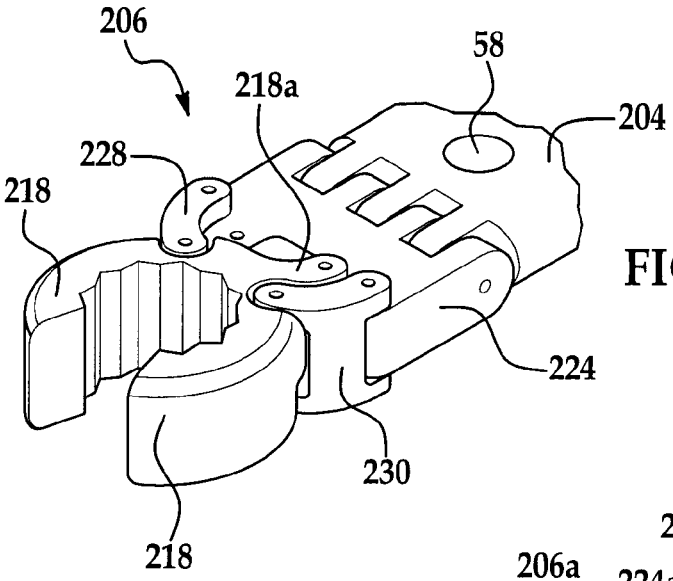
FIG. 17 is another perspective view of the torque wrench shown in FIGS. 15 and 16, but without the fastener.

Attention is now directed to FIGS. 15-17 which depict features of the electronic torque wrench 202 that may substantially eliminate cosine error. The electronic wrench 202 broadly comprises elongate handle 204 pivotally connected to head 206 by means of a hinge 216 that allows pivotal motion of the handle 204 about an axis 208. Thus, the hinge 216 allows the handle 204 to be swung or pivoted through an angle θ, out of the x-y plane shown in FIG. 14, to any of a plurality of positions in those applications where it may be necessary to avoid an obstruction 200 (FIG. 13).

The head 206 broadly comprises the first head portion 218 that engages the nut 38 and a second head portion 224 pivotally connected to the end of the handle 204 by means of the hinge 216. In the illustrated example, the first head portion 218 comprises opposing jaws 218*a* which engage flats 38*a* of the nut 38, however the first head portion 218 may have other geometries such as a socket configuration (not shown), depending on the application. The first and second head portions 218, 224 are pivotally connected by means of a torque reacting first link 226, and second and third connecting links 228, 230.

The torque reacting first link 226 is elongate and has its opposite ends respectively pivotally connected at pivot points 232 to an ear 218*a* on the first head portion 218, and to the second head portion 224. The torque reacting first link 226 has a longitudinal axis 235 which passes through pivot points 232 and extends perpendicular to a reference line 236 passing through the rotational axis 222 of the nut 38. The connecting links 228 are positioned on opposite sides of the torque reacting first link 226 and each have their opposite ends pivotally connected at pivot points 234, respectively to the first and second head portions 218, 224. Reference lines 238 connecting the pivot points 234 of each of the connecting links 228 each pass through the rotational axis 222.

Although the connecting links 228, 230 are positioned on opposite sides of the torque transmitting first link 226 in the illustrated example, other arrangements are possible; for example, the connecting links 228, 230 may be mounted on the same side of the torque reacting first link 226, or may lie in different planes. It should also be noted here that the use of more than two connecting links 228, 230 may be possible or desirable in some applications. While the illustrated hinge 216 employs pivotal connections formed by the pivotal links 228, 230, other types of flexible connections may be possible, using for example and without limitation, ball joints (not shown) and/or sliding joints (not shown).

An electronic strain gauge sensor 50 is mounted on the torque reacting first link 226 and functions to measure the amount of strain created in link 226 as a result of the force transmitted from the second head portion 224 to the first head portion 218 solely through the torque reacting first link 226. While a strain gauge sensor 50 has been illustrated in the disclosed embodiment, other types of sensors (not shown) may be employed to measure the torque transmitted through the torque reacting first link 226.

From the forgoing description, it may be appreciated that the torque reacting first link 226 along with the strain gauge 50 provide a means, located entirely within the flexible head 206 for measuring the amount of torque applied to the fastener 38. As a result of this arrangement, the measured torque readings are substantially unaffected by the pivotal position of the handle 204.

In operation, a force applied to the handle 204 is transmitted through the hinge 216 to the second head portion 224, which transmits the applied force through links 226, 228 and 230 to the first head portion 218 where it is applied to the fastener 38. The torque reacting first link 226 essentially isolates that portion of the force applied to the fastener 38 that results in a torque on the fastener 38, i.e. the force applied to the fastener 38 that is perpendicular to the axis of rotation 222, from the component $F_z$ of the force that is applied "off-axis", i.e., not perpendicular to the axis of rotation 222. The off-axis component $F_z$ of the force applied to the fastener 38 is transmitted substantially entirely through the second and third links 228, 230. Links 228, 230 thus form pivotal connections that hold the torque reacting first link 226 in a substantially fixed position on the wrench 202, and react against the off-axis component $F_z$ of the applied force F.

The electronic torque wrench 202 may be similar in other respects to the previously described electronic torque wrench 44 shown in FIGS. 4 and 5. For example and without limitation, the torque wrench 202 may include a measuring and trigging circuit 57 which functions to cause a transmitter 52 in the handle 204 to transmit wireless signals indicating the location and/or magnitude of the sensed torque. Similarly, the wrench 202 may include an annunciator 58 which may comprise, for example and without limitation, the LED shown in the drawings.

Figure 18:
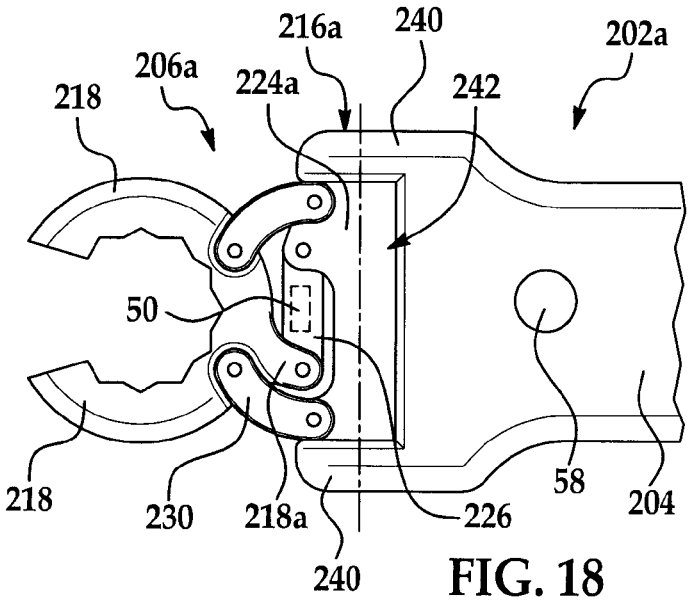
FIG. 18 is a top view of another embodiment of the electronic torque wrench.
Figure 19:
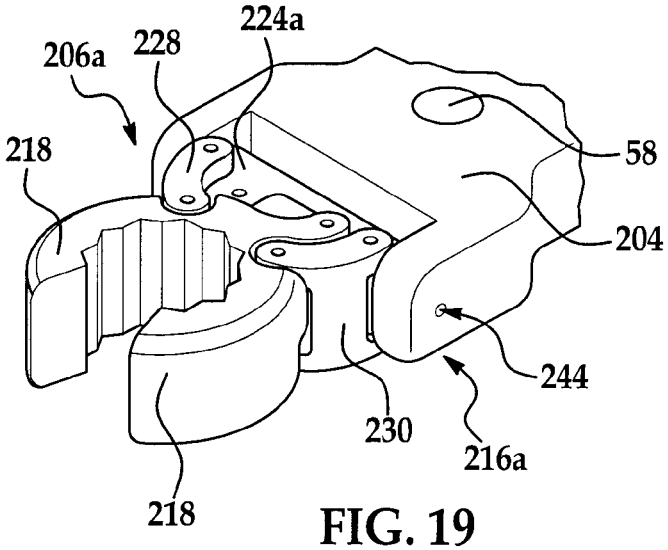
FIG. 19 is a perspective view of the electronic torque wrench shown in FIG. 18.

An alternate embodiment of the electronic torque wrench 202*a* is illustrated in FIGS. 18 and 19. Torque wrench 202*a* is similar to that previously described in connection with FIGS. 15-17, but includes an alternate form 216*a* of the hinge wherein the second head portions 224*a* is configured to be received within an opening 242 defined between spaced apart tines 240 that are integrally formed with the end of the handle 204. Pins 244 pivotally connect the opposite ends of the second head portion 224 with the tines 240.

Figure 20:
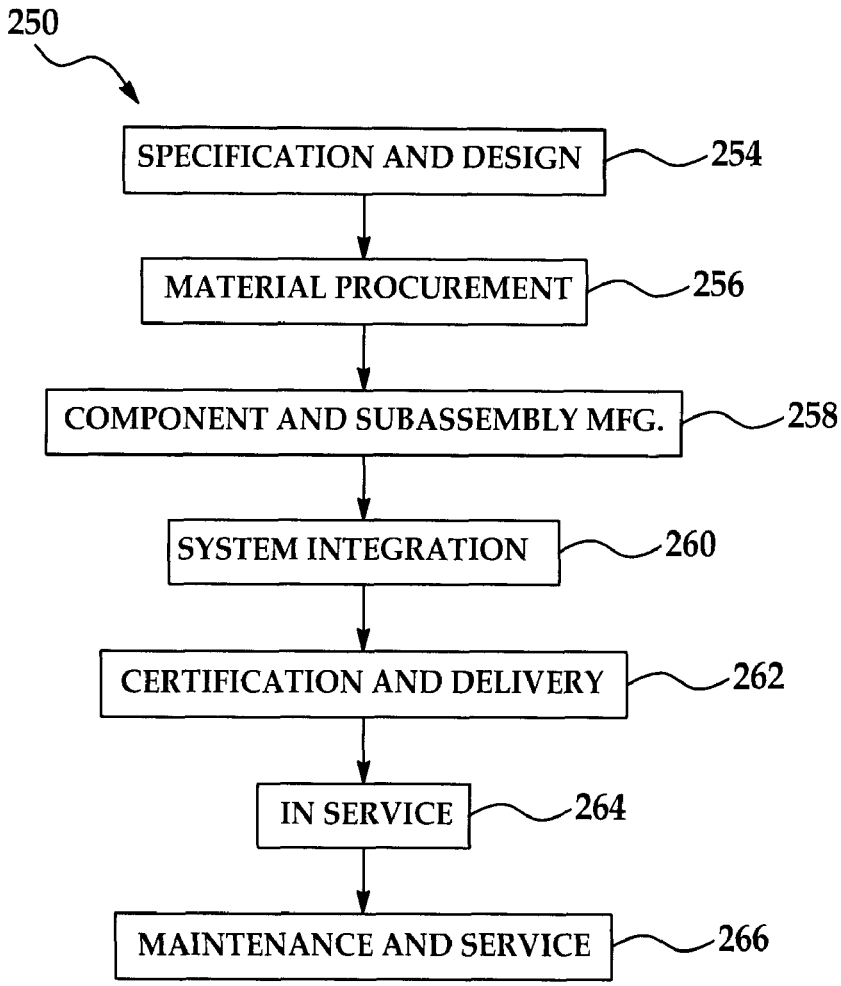
FIG. 20 is a flow diagram of aircraft production and service methodology.
Figure 21:
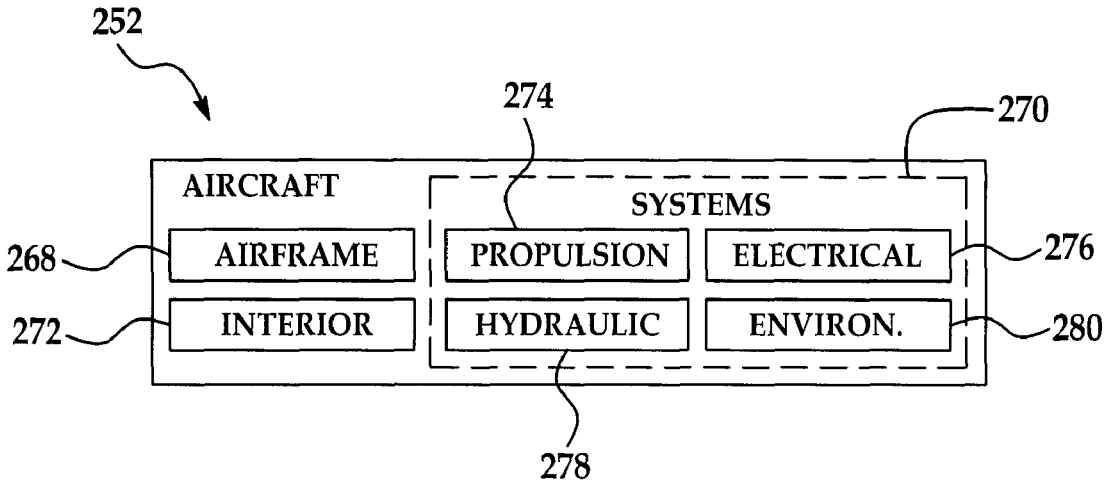
FIG. 21 is a block diagram of an aircraft.

Embodiments of the disclosure may find use in a variety of potential applications, particularly in the transportation industry, including for example, aerospace, marine and automotive applications. Thus, referring now to FIGS. 20 and 21, embodiments of the disclosure may be used in the context of an aircraft manufacturing and service method 250 as shown in FIG. 20 and an aircraft 252 as shown in FIG. 21. During pre-production, exemplary method 250 may include specification and design 254 of the aircraft 252 and material procurement 256. During production, component and subassembly manufacturing 258 and system integration 260 of the aircraft 252 takes place. Thereafter, the aircraft 252 may go through certification and delivery 262 in order to be placed in service 264. While in service by a customer, the aircraft 252 is scheduled for routine maintenance and service 266 (which may also include modification, reconfiguration, refurbishment, and so on).

Each of the processes of method 250 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 21, the aircraft 252 produced by exemplary method 250 may include an airframe 268 with a plurality of systems 270 and an interior 272. Examples of high-level systems 270 include one or more of a propulsion system 274, an electrical system 276, a hydraulic system 278, and an environmental system 280. Any number of other systems may be included. Although an aerospace example is shown, the principles of the disclosure may be applied to other industries, such as the marine and automotive industries.

Systems and methods embodied herein may be employed during any one or more of the stages of the production and service method 250. For example, components or subassemblies corresponding to production process 258 may be fabricated or manufactured in a manner similar to components or subassemblies produced while the aircraft 250 is in service. Also, one or more apparatus embodiments, method embodiments, or a combination thereof may be utilized during the production stages 258 and 260, for example, by substantially expediting assembly of or reducing the cost of an aircraft 250. Similarly, one or more of apparatus embodiments, method embodiments, or a combination thereof may be utilized while the aircraft 250 is in service, for example and without limitation, to maintenance and service 266.

Although the embodiments of this disclosure have been described with respect to certain exemplary embodiments, it is to be understood that the specific embodiments are for purposes of illustration and not limitation, as other variations will occur to those of skill in the art.

What is claimed is:

1. A torque wrench, comprising:

a handle; and, a head including a first portion for engaging and applying torque to a fastener about a rotational axis of the fastener, a second portion pivotally coupled with the handle for allowing the handle to pivot to any of a plurality of positions relative to the head, wherein the first and second portions of the head are connected by first, second and third links each pivotally connected between the first and second portions, wherein only the first link substantially reacts against force applied through the handle that imparts torque to the fastener, and means on the head for measuring the amount of torque applied to the fastener irrespective of the pivotal position of the handle.

2. The torque wrench of claim 1, wherein the measuring means is connected between the first and second portions of the head.

3. The torque wrench of claim 1, wherein the measuring means includes:

a link reacting against a force applied through the handle from the second portion of the head to the first portions of the head, and a strain gauge coupled with the link for measuring strain on the link produced by the reaction of the link against the force applied through the handle.

4. The torque wrench of claim 1, wherein the link includes:

opposite ends pivotally connected at first and second pivot points respectively to the first and second portions of the head, and a longitudinal axis passing though the first and second pivot points and extending substantially orthogonal to the rotational axis of the fastener.

5. The torque wrench of claim 1, wherein:

the second and third links each have opposite ends connected at pivot points respectively to the first and second portions of the head, and the second and third links substantially only react against a component of force applied through the handle that is not substantially perpendicular to the rotational axis of the fastener.

6. The torque wrench of claim 5, wherein the first link includes:

opposite ends pivotally connected at first and second pivot points respectively to the first and second portions of the head, and a longitudinal axis passing though the first and second pivot points and extending substantially orthogonal to the rotational axis of the fastener.

7. The torque wrench of claim 1, further comprising:

a wireless transmitter in the handle for transmitting a signal related to the amount of torque measured by the measuring means.

8. An electronic torque wrench having a flexible drive head, comprising:

a handle for applying a force;

a head including a first portion adapted to engage and apply a force to a fastener about an axis of rotation, and a second portion between the handle and the first portion;

a hinge pivotally connecting the handle with the second portion of the head and allowing the handle to pivot to any of a plurality of positions relative to the head;

a torque reacting first link connecting the first and second portions of the head for reacting against substantially the entire force applied through the handle to the first portion of the head irrespective of the pivotal position of the handle;

wherein the first link includes opposite ends respectively pivotally connected to the first and second portions of the head at pivot points, and a reference line passing through the pivot points extends substantial orthogonal to the axis of rotation and an electronic sensor on the head for measuring the amount of torque applied to the fastener.

9. The electronic torque wrench of claim 8, further comprising:

second and third links connecting the first and second portions of the head, the second and third links each have opposite ends connected at pivot points respectively to the first and second portions of the head, and wherein a reference axis passing through the pivot points for each of the second and third links extend through the axis of rotation.

10. The electronic torque wrench of claim 8, wherein the electronic sensor is connected between the first and second portions of the head.

11. The torque wrench of claim 10, wherein the electronic sensor includes a strain gauge for measuring the strain on the torque reacting first link.

12. The electronic torque wrench of claim 8, wherein electronic sensor includes a strain gauge mounted on the torque reacting first link.

13. The electronic torque wrench of claim 8, further comprising:

a wireless transmitter in the handle for transmitting a signal related to the amount of torque measured by the electronic sensor.

14. The electronic torque wrench of claim 13, further comprising:

a circuit for triggering the transmitter to transmit the signal when the electronic sensor senses that a preselected amount of torque has been applied to the fastener.

15. The electronic torque wrench of claim 8, further comprising:

an annunciator for alerting a user of the torque wrench that a preselected amount of torque has been applied to the fastener.

16. The electronic torque wrench of claim 8, further comprising:

second and third links connecting the first and second portions of the head for reacting against any off-axis force applied to the fastener by the handle.

17. A method of applying and measuring torque on a fastener using a torque wrench having a pivotal head, comprising:

separating the head into first and second portions;

connecting the first and second portions of the head by at least a first link;

pivotally connecting the first and second portions of the head by second and third pivotal links and using the second and third links to react a against off-axis force applied to the fastener, transmitting a force through the first link that results in substantially only torque being applied to the fastener; and, measuring the torque transmitted through the first link.

18. The method of claim 17, wherein connecting the first and second portions of the head is performed by pivotally connecting opposite ends of the first link respectively with the first and second portions of the head.

19. The method of claim 17, wherein measuring the torque transmitted through the first link is performed using a strain gauge sensor.

20. The method of claim 17, further comprising:

engaging the fastener with the first portion of the head, and pivotally connecting the second portion of the head with the handle.

21. An electronic torque wrench having a flexible drive head, comprising:

a handle to which a force may be applied;

a head including a first portion adapted to engage and apply a torque to a fastener within a plane extending substantially orthogonal to an axis about which the fastener rotates, and a second portion between the handle and the first portion;

a hinge pivotally connecting the handle with the second portion of the head and allowing the handle to pivot out of the plane to any of a plurality of positions relative to the head;

a torque reacting first link pivotally connecting the first and second portions of the head for reacting against substantially only torque applied through the handle to the first portion of the head irrespective of the pivotal position of the handle, the first link having pivot points on opposite ends thereof and a longitudinal axis passing through the pivot points and extending orthogonal to the axis about which the fastener rotates;

second and third links pivotally connecting the first and second portions of the head and reacting to off-axis force applied to the fastener by through the handle to the first portion; and, a strain gauge on the first link for measuring the amount of torque applied to the fastener though the first link.

22. A method of applying and measuring torque on a fastener using a torque wrench having a head pivotally connected to a handle, comprising:

providing first and second head portions;

engaging the fastener with the first head portion;

pivotally connecting the first and second head portions using pivotal connections on opposite ends of a first link;

pivotally connecting the first and second head portions by second and third links;

pivotally connecting a handle to the second head portion;

transmitting substantially all of the torque applied to the fastener through the first link; and, using the second and third links to react against off-axis force applied to the fastener; and, using an electronic strain gauge to measure the torque transmitted through the first link.

* * * * *